US011249411B2

(12) United States Patent
Takeda

(10) Patent No.: US 11,249,411 B2
(45) Date of Patent: Feb. 15, 2022

(54) TONER, TONER CARTRIDGE, AND IMAGE FORMING APPARATUS

(71) Applicant: TOSHIBA TEC KABUSHIKI KAISHA, Tokyo (JP)

(72) Inventor: Yuichiro Takeda, Fuji Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/094,362

(22) Filed: Nov. 10, 2020

(65) Prior Publication Data

US 2021/0397107 A1 Dec. 23, 2021

(30) Foreign Application Priority Data

Jun. 19, 2020 (JP) ..... JP2020-105943

(51) Int. Cl.
*G03G 9/097* (2006.01)
*G03G 9/087* (2006.01)
*G03G 9/08* (2006.01)

(52) U.S. Cl.
CPC ..... *G03G 9/08755* (2013.01); *G03G 9/0819* (2013.01); *G03G 9/08782* (2013.01); *G03G 9/08797* (2013.01); *G03G 9/09708* (2013.01); *G03G 9/09725* (2013.01)

(58) Field of Classification Search
CPC ..... G03G 9/08782; G03G 9/09725
See application file for complete search history.

(56) References Cited

U.S. PATENT DOCUMENTS

2003/0224278 A1 12/2003 Shirai et al.
2015/0309435 A1* 10/2015 Kuroyama ..... G03G 9/0819 430/105
2018/0074421 A1 3/2018 Uchino et al.

FOREIGN PATENT DOCUMENTS

JP 2009-181005 A 8/2009
JP 2012-027142 A 2/2012

* cited by examiner

*Primary Examiner* — Peter L Vajda
(74) *Attorney, Agent, or Firm* — Foley & Lardner LLP

(57) ABSTRACT

A toner according to an embodiment includes toner base particles and an external additive. The external additive contains silica particles having a $D_{50}$ of 70 to 120 nm. The joining degree of the silica particles is 80% or more. The toner base particles contain a crystalline polyester resin and an ester wax. The ester wax is a condensation polymer of three or more types of carboxylic acids and two or more types of alcohols. The proportion of a carboxylic acid, the content of which is highest, is between 70 and 95 mass %. The proportion of a carboxylic acid with a carbon number of 18 or less is 5 mass % or less. The proportion of an alcohol, the content of which is highest, is between 70 and 90 mass %. The proportion of an alcohol with a carbon number of 18 or less is 20 mass % or less.

14 Claims, 1 Drawing Sheet

TONER, TONER CARTRIDGE, AND IMAGE FORMING APPARATUS

CROSS-REFERENCE TO RELATED APPLICATION

This application is based upon and claims the benefit of priority from Japanese Patent Application No. 2020-105943, filed on Jun. 19, 2020, the entire contents of which are incorporated herein by reference.

FIELD

Embodiments described herein relate generally to a toner, a toner cartridge, and an image forming apparatus.

BACKGROUND

There is known a toner containing a crystalline polyester resin (for example, Japanese Patent No. 3693327). The toner containing a crystalline polyester resin has excellent low-temperature fixability. However, the toner containing a crystalline polyester resin has insufficient heat resistance and storage stability. Therefore, in the toner containing a crystalline polyester resin, soft caking is likely to occur under high temperature. The toner in which soft caking occurred is solidified in an image forming apparatus to cause clogging or an image defect. Accordingly, the improvement of heat resistance and storage stability is required for the toner containing a crystalline polyester resin.

On the other hand, the use of an ester wax having excellent heat resistance is effective in the improvement of the heat resistance and storage stability of a toner. However, when an ester wax and a crystalline polyester resin are used together, the dispersibility of the components in a toner is likely to deteriorate. As a result, the electric charge amount of the toner is hardly controlled. In addition, the electric charge amount of the toner is more hardly maintained under high temperature and high humidity as in an image forming apparatus, and the scattering amount of the toner is likely to decrease. The toner whose scattering amount decreased is deposited in the apparatus to cause contamination.

In this manner, the toner containing a crystalline polyester resin hardly achieves both excellent low-temperature fixability and maintenance of an electric charge amount at the same time.

DETAILED DESCRIPTION

Figure 1:
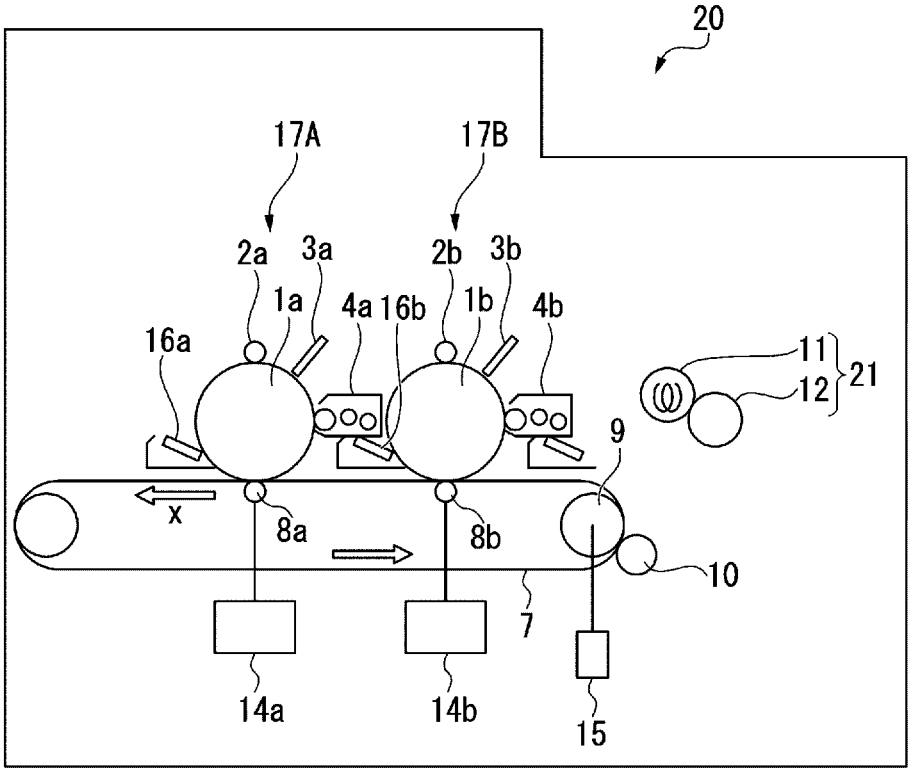
FIG. 1 a diagram showing an example of a schematic structure of an image forming apparatus of an embodiment.

An object to be achieved by embodiments is to provide a toner having excellent low-temperature fixability, storage stability, and heat resistance, and capable of sufficiently maintaining an electric charge amount even under high temperature and high humidity, and a toner cartridge and an image forming apparatus, in each of which the toner is stored.

A toner according to an embodiment includes toner base particles and an external additive. The external additive is adhered to surfaces of the toner base particles. The toner base particles contain a crystalline polyester resin and an ester wax.

The ester wax is a condensation polymer of a first monomer group and a second monomer group. The first monomer group is composed of at least three or more types of carboxylic acids. The second monomer group is composed of at least two or more types of alcohols.

The proportion of a carboxylic acid with a carbon number of $C_n$ is between 70 and 95 mass % with respect to 100 mass % of the first monomer group. The carbon number $C_n$ is the carbon number of a carboxylic acid, the content of which is highest in the first monomer group. The proportion of a carboxylic acid with a carbon number of 18 or less in the first monomer group is 5 mass % or less with respect to 100 mass % of the first monomer group.

The proportion of an alcohol with a carbon number of $C_m$ is between 70 and 90 mass % with respect to 100 mass % of the second monomer group. The carbon number $C_m$ is the carbon number of an alcohol, the content of which is highest in the second monomer group. The proportion of an alcohol with a carbon number of 18 or less in the second monomer group is 20 mass % or less with respect to 100 mass % of the second monomer group.

The external additive contains silica particles having a volume average primary particle diameter ($D_{50}$) of 70 to 120 nm. The silica particles are composed of primary particles of silica and secondary particles. The secondary particles are each a joined material in which two or more primary particles of silica are joined together. A joining degree calculated according to the following formula of the silica particles is 80% or more.

$$\text{joining degree } (\%)=(n_2/(n_1+n_2))\times 100$$

In the formula, $n_1$ is the number of primary particles measured for one toner base particle, and $n_2$ is the number of secondary particles measured for one toner base particle.

Hereinafter, the toner according to the embodiment is described herein.

The toner according to the embodiment includes toner base particles and an external additive.

The toner base particles is described herein.

The toner base particles of the embodiment contain a crystalline polyester resin and an ester wax. The toner base particles of the embodiment may further contain another binder resin other than the crystalline polyester resin and a colorant in addition to the crystalline polyester resin and the ester wax. The toner base particles of the embodiment may further contain another component other than the crystalline polyester resin, the ester wax, the another binder resin, and the colorant as long as the effect disclosed in the embodiment is obtained.

The crystalline polyester resin is described herein.

The crystalline polyester resin functions as a binder resin. Since the toner base particles contain a crystalline polyester resin, the toner of the embodiment has excellent low-temperature fixability.

In the embodiment, a polyester resin in which the ratio of the softening temperature to the melting temperature (softening temperature/melting temperature) is between 0.8 and 1.2 is defined as the "crystalline polyester resin". Further, a polyester resin in which the ratio of the softening temperature to the melting temperature (softening temperature/melting temperature) is less than 0.8 or more than 1.2 is defined as an "amorphous polyester resin".

As the crystalline polyester resin, for example, a condensation polymer of a dihydric or higher hydric alcohol and a divalent or higher valent carboxylic acid is exemplified.

Examples of the dihydric or higher hydric alcohol include ethylene glycol, 1,2-propylene glycol, 1,3-propylene glycol, 1,4-butanediol, 1,5-pentanediol, 1,6-hexanediol, neopentyl glycol, 1,4-butenediol, polyoxypropylene, polyoxyethylene, glycerin, pentaerythritol, and trimethylolpropane. As the dihydric or higher hydric alcohol, 1,4-butanediol or 1,6-hexanediol is preferred.

Examples of the divalent or higher valent carboxylic acid include adipic acid, oxalic acid, malonic acid, maleic acid, fumaric acid, citraconic acid, itaconic acid, glutaconic acid, succinic acid, phthalic acid, isophthalic acid, terephthalic acid, sebacic acid, azelaic acid, succinic acid substituted with an alkyl group or an alkenyl group, cyclohexane dicarboxylic acid, trimellitic acid, pyromellitic acid, and acid anhydrides thereof or esters thereof.

Examples of the succinic acid substituted with an alkyl group or an alkenyl group include succinic acid substituted with an alkyl group or an alkenyl group having 2 to 20 carbon atoms. For example, n-dodecenyl succinic acid, n-dodecyl succinic acid, and the like are exemplified. As the divalent or higher valent carboxylic acid, fumaric acid is preferred.

However, the crystalline polyester resin is not limited to the condensation polymer of a dihydric or higher hydric alcohol and a divalent or higher valent carboxylic acid exemplified here. As the crystalline polyester resin, anyone type may be used by itself or two or more types may be used in combination.

The mass average molecular weight of the crystalline polyester resin is preferably between $6\times10^3$ and $18\times10^3$, more preferably between $8\times10^3$ and $14\times10^3$. When the mass average molecular weight of the crystalline polyester resin is the above lower limit or more, the toner has more excellent low-temperature fixability. In addition, when the mass average molecular weight of the crystalline polyester resin is the above upper limit or less, the toner has more excellent storage stability, and also has excellent low-temperature offset resistance.

The mass average molecular weight as used herein is a value in terms of polystyrene measured by gel permeation chromatography.

The melting point of the crystalline polyester resin is preferably between 60 and 120° C., more preferably between 70 and 115° C., further more preferably between 80 and 110° C. When the melting point of the crystalline polyester resin is the above lower limit or more, the toner has more excellent storage stability and heat resistance. When the melting point of the crystalline polyester resin is the above upper limit or less, the toner has more excellent low-temperature fixability.

The melting point of the crystalline polyester resin can be measured by, for example, differential scanning calorimetry (DSC).

The another binder resin is described herein.

Examples of the another binder resin include an amorphous polyester resin, a styrene-based resin, an ethylene-based resin, an acrylic resin, a phenolic resin, an epoxy-based resin, an allyl phthalate-based resin, a polyamide-based resin, and a maleic acid-based resin. However, the another binder resin is not limited to these examples.

As the another binder resin, any one type may be used by itself or two or more types may be used in combination.

As the another binder resin, an amorphous polyester resin is preferred from the viewpoint that the effect disclosed in the embodiment is easily obtained. As the amorphous polyester resin, for example, a condensation polymer of a divalent or higher valent carboxylic acid and a dihydric alcohol is exemplified.

Examples of the divalent or higher valent carboxylic acid include a divalent or higher valent carboxylic acid, an acid anhydride of a divalent or higher valent carboxylic acid, and an ester of a divalent or higher valent carboxylic acid. Examples of the ester of a divalent or higher valent carboxylic acid include a lower alkyl (C1 to C12) ester of a divalent or higher valent carboxylic acid.

Examples of the dihydric alcohol include ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, hydrogenated bisphenol A, and an alkylene oxide adduct of bisphenol A. However, the dihydric alcohol is not limited to these examples.

Examples of the alkylene oxide adduct of bisphenol A include a compound obtained by adding 1 to 10 moles on the average of an alkylene oxide having 2 to 3 carbon atoms to bisphenol A. Examples of the alkylene oxide adduct of bisphenol A include polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane.

As the dihydric alcohol, an alkylene oxide adduct of bisphenol A is preferred. As the dihydric alcohol, any one type may be used by itself or two or more types may be used in combination.

The another binder resin is obtained by, for example, polymerizing a vinyl polymerizable monomer by itself or a plurality of types of vinyl polymerizable monomers.

Examples of the vinyl polymerizable monomer include an aromatic vinyl monomer, an ester-based monomer, a carboxylic acid-containing monomer, and an amine-based monomer.

Examples of the aromatic vinyl monomer include styrene, methylstyrene, methoxystyrene, phenylstyrene, chlorostyrene, and derivatives thereof.

Examples of the ester-based monomer include methyl acrylate, ethyl acrylate, butyl acrylate, methyl methacrylate, ethyl methacrylate, butyl methacrylate, and derivatives thereof.

Examples of the carboxylic acid-containing monomer include acrylic acid, methacrylic acid, fumaric acid, maleic acid, and derivatives thereof.

Examples of the amine-based monomer include amino acrylate, acrylamide, methacrylamide, vinylpyridine, vinylpyrrolidone, and derivatives thereof.

The another binder resin may be obtained by polycondensation of a polymerizable monomer component composed of an alcohol component and a carboxylic acid component. In the polycondensation of the polymerizable monomer component, various auxiliary agents such as a chain transfer agent, a crosslinking agent, a polymerization initiator, a surfactant, an aggregating agent, a pH adjusting agent, and an anti-foaming agent may be used.

The ester wax is described herein.

The ester wax of the embodiment is composed of two or more types of ester compounds with a different carbon number. Since the toner base particles contain the ester wax, the toner has excellent heat resistance and storage stability.

The ester wax of the embodiment is a condensation polymer of a first monomer group and a second monomer group.

The first monomer group is described herein.

The first monomer group is composed of at least three or more types of carboxylic acids. The number of types of carboxylic acids in the first monomer group is preferably 7 types or less, more preferably 5 types or less, further more preferably 4 types or less from the viewpoint that the ester wax is easy to obtain.

Here, the carbon number of a carboxylic acid, the content of which is highest in the first monomer group, is denoted by $C_n$. The carbon number $C_n$ is preferably between 19 and 28, more preferably between 19 and 24, furthermore preferably between 20 and 24. When the carbon number $C_n$ is the above lower limit or more, the heat resistance of the ester wax is improved. When the carbon number $C_n$ is the above upper limit or less, the toner has more excellent low-temperature fixability. The proportion of the carboxylic acid with a carbon number of $C_n$, the content of which is highest, is preferably between 70 and 95 mass %, more preferably between 80 and 95 mass %, furthermore preferably between 85 and 95 mass % with respect to 100 mass % of the first monomer group. When the proportion of the carboxylic acid with a carbon number of $C_n$ is the above lower limit or more, the maximum peak of the carbon number distribution of the ester wax is easily located sufficiently on the high carbon number side. When the proportion of the carboxylic acid with a carbon number of $C_n$ is the above upper limit or less, the ester wax is easy to obtain.

The proportion of a carboxylic acid with a carbon number of 18 or less in the first monomer group is preferably 5 mass % or less, more preferably between 0 and 5 mass %, further more preferably between 0 and 1 mass % with respect to 100 mass % of the first monomer group. When the proportion of the carboxylic acid with a carbon number of 18 or less is the above lower limit or more, the ester wax is easy to obtain. When the proportion of the carboxylic acid with a carbon number of 18 or less is the above upper limit or less, the proportion of an ester compound having a relatively low molecular weight in the ester wax becomes small. As a result, the toner has excellent storage stability and heat resistance.

The content of each of the carboxylic acids with the corresponding carbon number in the first monomer group can be measured by, for example, performing mass spectrometry using FD-MS (field desorption mass spectrometry) for a product after a methanolysis reaction of the ester wax. The total ionic strength of the carboxylic acids with the corresponding carbon number in the product obtained by the measurement using FD-MS is assumed to be 100. The relative value of the ionic strength of each of the carboxylic acids with the corresponding carbon number with respect to the total ionic strength is calculated. The calculated relative value is defined as the content of each of the carboxylic acids with the corresponding carbon number in the first monomer group. Further, the carbon number of the carboxylic acid with a carbon number, the relative value of which is highest, is denoted by $C_n$.

As the carboxylic acid in the first monomer group, a long-chain carboxylic acid is preferred from the viewpoint that the ester wax is easy to obtain, and a long-chain alkyl carboxylic acid is more preferred. The long-chain carboxylic acid is appropriately selected so that the ester wax meets the predetermined requirements.

The long-chain carboxylic acid is preferably a long-chain carboxylic acid with a carbon number of 19 to 28, more preferably a long-chain carboxylic acid with a carbon number of 20 to 24. When the carbon number of the long-chain carboxylic acid is the above lower limit or more, the heat resistance of the ester wax is improved, and the toner has more excellent storage stability and heat resistance. When the carbon number of the long-chain carboxylic acid is the above upper limit or less, the toner has more excellent low-temperature fixability.

Examples of the long-chain alkyl carboxylic acid include palmitic acid, stearic acid, arachidonic acid, behenic acid, lignoceric acid, cerotic acid, and montanic acid.

The second monomer group is described herein.

The second monomer group is composed of at least two or more types of alcohols. The number of types of alcohols in the second monomer group is preferably 5 types or less, more preferably 4 types or less, further more preferably 3 types or less from the viewpoint that the ester wax is easy to obtain.

Here, the carbon number of the alcohol, the content of which is highest in the second monomer group, is denoted by $C_m$. The carbon number $C_m$ is preferably between 19 and 28, more preferably between 20 and 24, further more preferably between 20 and 22. When the carbon number $C_m$ is the above lower limit or more, the heat resistance of the ester wax is improved. When the carbon number $C_m$ is the above upper limit or less, the toner has more excellent low-temperature fixability.

The proportion of the alcohol with a carbon number of $C_m$, the content of which is highest, is preferably between 70 and 90 mass %, more preferably between 80 and 90 mass %, further more preferably between 85 and 90 mass % with respect to 100 mass % of the second monomer group. When the proportion of the alcohol with a carbon number of $C_m$ is the above lower limit or more, the maximum peak of the carbon number distribution of the ester wax is easily located sufficiently on the high carbon number side. When the proportion of the alcohol with a carbon number of $C_m$ is the above upper limit or less, the ester wax is easy to obtain.

The proportion of an alcohol with a carbon number of 18 or less in the second monomer group is preferably 20 mass % or less, more preferably between 10 and 20 mass %, further more preferably between 15 and 20 mass % with respect to 100 mass % of the second monomer group. When the proportion of the alcohol with a carbon number of 18 or less is the above lower limit or more, the ester wax is easy to obtain. When the proportion of the alcohol with a carbon number of 18 or less is the above upper limit or less, the proportion of an ester compound having a relatively low molecular weight in the ester wax becomes small. As a result, the toner has excellent storage stability and heat resistance.

The content of each of the alcohols with the corresponding carbon number in the second monomer group can be measured by, for example, performing mass spectrometry using FD-MS for a product after a methanolysis reaction of the ester wax. The total ionic strength of the alcohols with the corresponding carbon number in the product obtained by the measurement using FD-MS is assumed to be 100. The relative value of the ionic strength of each of the alcohols with the corresponding carbon number with respect to the total ionic strength is calculated. The calculated relative value is defined as the content of each of the alcohols with the corresponding carbon number in the second monomer group. Further, the carbon number of the alcohol with a carbon number, the relative value of which is highest, is denoted by $C_m$.

As the alcohol in the second monomer group, a long-chain alcohol is preferred from the viewpoint that the ester wax is easy to obtain, and a long-chain alkyl alcohol is more preferred. The long-chain alcohol is appropriately selected so that the ester wax meets the predetermined requirements. The long-chain alcohol is preferably a long-chain alcohol with a carbon number of 19 to 28, more preferably a long-chain alcohol with a carbon number of 20 to 22. When the carbon number of the long-chain alcohol is the above lower limit or more, the heat resistance of the ester wax is improved, and the toner has more excellent storage stability and heat resistance. When the carbon number of the long-chain alcohol is the above upper limit or less, the toner has more excellent low-temperature fixability.

Examples of the long-chain alkyl alcohol include palmityl alcohol, stearyl alcohol, arachidyl alcohol, behenyl alcohol, lignoceryl alcohol, ceryl alcohol, and montanyl alcohol.

In the ester wax of the embodiment, an ester compound with a carbon number of $C_l$, the content of which is highest among the ester compounds constituting the ester wax of the embodiment, is preferably present. The carbon number $C_l$ is preferably 43 or more, more preferably between 43 and 56, further more preferably between 43 and 52, particularly preferably between 44 and 46, and most preferably 44. When the carbon number $C_l$ is the above lower limit or more, the maximum peak of the carbon number distribution of the ester wax is located sufficiently on the high carbon number side. As a result, the toner has more excellent storage stability and heat resistance. When the carbon number $C_l$ is the above upper limit or less, the ester wax is easy to obtain.

The ester compound with a carbon number of $C_l$ is represented by the following formula (I).

$$R^1COOR^2 \quad (I)$$

In the formula (I), $R^1$ and $R^2$ are each an alkyl group. The total carbon number of $R^1$ and $R^2$ is preferably 42 or more, more preferably between 42 and 55, further more preferably between 42 and 51, particularly preferably between 43 and 45, and most preferably 43. When the total carbon number of $R^1$ and $R^2$ is the above lower limit or more, the toner has more excellent storage stability and heat resistance. When the total carbon number of $R^1$ and $R^2$ is the above upper limit or less, the ester wax is easy to obtain. The carbon number of $R^1$ can be controlled by adjusting the carbon number $C_n$ of the below-mentioned carboxylic acid with a carbon number of $C_n$. The carbon number of $R^2$ can be controlled by adjusting the carbon number $C_m$ of the below-mentioned alcohol with a carbon number of $C_m$.

The proportion of the ester compound with a carbon number of $C_l$ is preferably 65 mass % or more, more preferably between 65 and 90 mass %, further more preferably between 70 and 90 mass %, and particularly preferably between 80 and 90 mass % with respect to 100 mass % of the ester wax. When the proportion of the ester compound with a carbon number of $C_l$ is the above lower limit or more, the maximum peak of the carbon number distribution of the ester wax becomes sufficiently high. As a result, the toner has more excellent storage stability and heat resistance.

When the proportion of the ester compound with a carbon number of $C_l$ is the above upper limit or less, the ester wax is easy to obtain.

The carbon number distribution of the ester wax of the embodiment preferably has only one maximum peak in a region where the carbon number is 43 or more. In that case, the proportion of an ester compound having a relatively low molecular weight becomes small. As a result, the toner has more excellent storage stability and heat resistance.

In the carbon number distribution of the ester wax of the embodiment, the position of the maximum peak is preferably in a region where the carbon number is between 43 and 56, more preferably in a region where the carbon number is between 44 and 52, further more preferably in a region where the carbon number is between 44 and 46, and most preferably at a position where the carbon number is 44. When the position of the maximum peak is in a region where the carbon number is the above lower limit or more, the toner has more excellent storage stability and heat resistance. When the position of the maximum peak is in a region where the carbon number is the above upper limit or less, the ester wax is easy to obtain.

The content of each of the ester compounds with the corresponding carbon number in the ester wax can be measured by, for example, mass spectrometry using FD-MS. The total ionic strength of the ester compounds with the corresponding carbon number in the ester wax obtained by the measurement using FD-MS is assumed to be 100. The relative value of the ionic strength of each of the ester compounds with the corresponding carbon number with respect to the total ionic strength is calculated. The calculated relative value is defined as the content of each of the ester compounds with the corresponding carbon number in the ester wax. Further, the carbon number of the ester compound with a carbon number, the relative value of which is highest, is denoted by $C_l$.

A method for preparing the ester wax is described herein. The ester wax can be prepared by, for example, subjecting a long-chain carboxylic acid and a long-chain alcohol to an esterification reaction. In the esterification reaction, at least three or more types of long-chain alkyl carboxylic acids and at least two or more types of long-chain alkyl alcohols are preferably used from the viewpoint that the ester wax that meets the predetermined requirements is easily obtained. When the used amount of each of the at least three types of long-chain alkyl carboxylic acids and the at least two types of long-chain alkyl alcohols is adjusted, the carbon number distribution of the ester compounds contained in the ester wax can be adjusted. The esterification reaction is preferably performed while heating under a nitrogen gas stream.

The esterification reaction product may be purified by being dissolved in a solvent containing ethanol, toluene, or the like, and further adding a basic aqueous solution such as a sodium hydroxide aqueous solution to separate the solution into an organic layer and an aqueous layer. By removing the aqueous layer, the ester wax can be obtained. The purification operation is preferably repeated a plurality of times.

The colorant is described herein.

The colorant is not particularly limited. Examples thereof include carbon black, cyan, yellow, and magenta-based pigments and dyes.

Examples of the carbon black include aniline black, lamp black, acetylene black, furnace black, thermal black, channel black, and Ketjen black.

Examples of the pigments and dyes include Fast Yellow G, benzidine yellow, chrome yellow, quinoline yellow, Indofast Orange, Irgazin Red, Carmine FB, Permanent Bordeaux FRR, Pigment Orange R, Lithol Red 2G, Lake Red C, Rhodamine FB, Rhodamine B Lake, Du Pont Oil Red, Phthalocyanine Blue, Pigment Blue, aniline blue, Calcoil Blue, ultramarine blue, brilliant green B, phthalocyanine green, malachite green oxalate, methylene blue chloride, Rose Bengal, and quinacridone.

Examples of the colorant include C.I. Pigment Black 1, 6, and 7, C.I. Pigment Yellow 1, 12, 14, 17, 34, 74, 83, 97, 155, 180, and 185, C.I. Pigment Orange 48 and 49, C.I. Pigment Red 5, 12, 31, 48, 48:1, 48:2, 48:3, 48:4, 48:5, 49, 53, 53:1, 53:2, 53:3, 57, 57:1, 81, 81:4, 122, 146, 150, 177, 185, 202, 206, 207, 209, 238, and 269, C.I. Pigment Blue 15, 15:1, 15:2, 15:3, 15:4, 15:5, 15:6, 75, 76, and 79, C.I. Pigment Green 1, 7, 8, 36, 42, and 58, C.I. Pigment Violet 1, 19, and 42, and C.I. Acid Red 52, each of which is indicated by the Color Index Number. However, the colorant is not limited to these examples.

As the colorant, any one type may be used by itself or two or more types may be used in combination.

The another component is described herein.

Examples of the another component include additives such as a charge control agent, a surfactant, a basic compound, an aggregating agent, a pH adjusting agent, and an antioxidant. However, the additive is not limited to these examples. As the additive, any one type may be used by itself or two or more types may be used in combination.

The charge control agent is described herein.

When the toner base particles contain the charge control agent, the toner is easily transferred onto a recording medium such as paper. Examples of the charge control agent include a metal-containing azo compound, a metal-containing salicylic acid derivative compound, a hydrophobized metal oxide, and a polysaccharide inclusion compound. As the metal-containing azo compound, a complex or a complex salt in which the metal is iron, cobalt, or chromium, or a mixture thereof is preferred. As the metal-containing salicylic acid derivative compound and the hydrophobized metal oxide, a complex or a complex salt in which the metal is zirconium, zinc, chromium, or boron, or a mixture thereof is preferred. As the polysaccharide inclusion compound, a polysaccharide inclusion compound containing aluminum (Al) and magnesium (Mg) is preferred.

The composition of the toner base particles is described herein.

The content of the crystalline polyester resin is preferably between 5 and 25 mass %, more preferably between 5 and 20 mass %, further more preferably between 5 and 15 mass % with respect to 100 mass % of the toner base particles. When the content of the crystalline polyester resin is the above lower limit or more, the toner has more excellent low-temperature fixability. When the content of the crystalline polyester resin is the above upper limit or less, the toner has more excellent low-temperature offset resistance and high-temperature offset resistance.

The content of the ester wax is preferably between 3 and 15 mass %, more preferably between 3 and 13 mass %, further more preferably between 5 and 10 mass % with respect to 100 mass % of the toner base particles. When the content of the ester wax is the above lower limit or more, the toner has more excellent storage stability and heat resistance. Further, when the content of the ester wax is the above upper limit or less, the toner has more excellent low-temperature fixability, and the electric charge amount is easily sufficiently maintained.

When the toner base particles contain an amorphous polyester resin, the content of the amorphous polyester resin is preferably between 60 and 90 mass %, more preferably between 65 and 85 mass %, further more preferably between 70 and 80 mass % with respect to 100 mass % of the toner base particles. When the content of the amorphous polyester resin is the above lower limit or more, the toner has more excellent offset resistance. Further, when the content of the amorphous polyester resin is the above upper limit or less, the toner has more excellent low-temperature fixability.

When the toner base particles contain a colorant, the content of the colorant is preferably between 2 and 13 mass %, more preferably between 3 and 8 mass % with respect to 100 mass % of the toner base particles. When the content of the colorant is the above lower limit or more, the toner has excellent color reproducibility. Further, when the content of the colorant is the above upper limit or less, the dispersibility of the colorant is excellent and the toner has more excellent low-temperature fixability. In addition, the electric charge amount of the toner is easily controlled.

The external additive is described herein.

The external additive contains specific silica particles α. The silica particles α have a volume average primary particle diameter $D_{50}$ of 70 to 120 nm, and a joining degree of 80% or more. The silica particles α are composed of primary particles of silica and secondary particles. The primary particle of silica means one particle composed of silica. The primary particle of silica is preferably a spherical shape, more preferably a true spherical shape.

The secondary particle is a joined material in which two or more primary particles of silica are joined together. Therefore, the secondary particle has an indefinite shape. A specific shape of the secondary particle is not particularly limited. The shape of the secondary particle may be a polygonal prism shape, or a polyhedron shape, or an elliptical shape.

The aspect ratio of the secondary particle can be set to 0.92 or less. The aspect ratio of the secondary particle is the ratio of a minor axis to a major axis.

As the silica particles α, hydrophobic silica particles are preferred from the viewpoint that the toner has more excellent heat resistance. The hydrophobic silica particles are obtained by, for example, hydrophobizing a surface silanol group of the below-mentioned wet silica with silane, silicone, or the like. When the hydrophobic silica particles are used as the external additive of the toner, the adhesiveness thereof to the toner base particles is improved.

The degree of hydrophobization of the hydrophobic silica can be measured by, for example, the following method. 50 mL of ion exchanged water and 0.2 g of a sample are placed in a beaker, and methanol is added dropwise thereto from a burette while stirring using a magnetic stirrer. Then, a powder gradually precipitates as the concentration of methanol in the beaker increases, and the volume percent of methanol in the mixed solution of methanol and ion exchanged water at the end point when the total amount thereof precipitated is defined as the degree of hydrophobization (%).

The joining degree of the silica particles α is 80% or more, preferably between 80 and 95%, more preferably between 80 and 90%. Since the joining degree of the silica particles α is the above lower limit or more, the proportion of silica having an indefinite shape in the external additive is high. Therefore, the silica particles α are hardly detached from the surfaces of the toner base particles. In this manner, the adhesion strength of the external additive to the toner base particles is enhanced, and therefore, the external additive is hardly detached even if the toner is stirred in a developing device under high temperature and high humidity. As a result, the toner can sufficiently maintain the electric charge amount even under high temperature and high humidity. When the joining degree of the silica particles α is the above upper limit or less, the external additive is easily uniformly adhered to the surfaces of the toner base particles.

Therefore, the electric charge amount distribution shows a sharp shape, and the electric charge amount is easily controlled.

The joining degree of the silica particles α is calculated according to the following formula.

$$\text{joining degree } (\%)=(n_2/(n_1+n_2))\times 100$$

In the formula, $n_1$ is the number of primary particles measured for one toner base particle, and $n_2$ is the number of secondary particles measured for one toner base particle.

The $n_1$ and $n_2$ can be measured by, for example, observation and an image analysis of an electron micrograph.

The volume average primary particle diameter ($D_{50}$) of the silica particles α is between 70 and 120 nm, preferably between 75 and 115 nm, more preferably between 80 and 110 nm. When the volume average primary particle diameter ($D_{50}$) of the silica particles α is the above lower limit or more, the electric charge amount of the toner of the embodiment becomes large, and the scattering amount of the toner is sufficiently maintained. When the volume average primary particle diameter ($D_{50}$) of the silica particles α is the above upper limit or less, the toner of the embodiment is hardly excessively charged, so that the scattering amount of the toner hardly becomes excessively large. As a result, damage to a photoconductor in an image forming apparatus is reduced.

As the silica particles α, wet silica is preferred from the viewpoint that the electric charge amount of the toner is more sufficiently maintained. The wet silica can be produced by, for example, a method (liquid phase method) in which sodium silicate made from silica sand is used as a raw material, and an aqueous solution containing sodium silicate is neutralized to deposit silica, and the silica is filtered and dried. On the other hand, fumed silica (dry silica) obtained by reacting silicon tetrachloride in a flame at high temperature is known. When wet silica is used as the external additive of the toner, the electric charge amount of the toner is generally easily maintained as compared with fumed silica having a low moisture content.

The external additive preferably further contains either one or both of strontium titanate and titanium oxide in addition to the silica particles α. When the external additive further contains either one or both of strontium titanate and titanium oxide, the electric charge amount of the toner hardly becomes excessively large. In addition, the electric charge amount distribution of the toner is likely to show a sharp shape. As a result, the scattering amount of the toner hardly becomes excessively large, and damage to a photoconductor in an image forming apparatus is reduced. Further, the electric charge amount of the toner is moderately maintained even under low temperature and low humidity.

The external additive may further contain another inorganic oxide other than the silica particles, strontium titanate, and titanium oxide. Examples of the another inorganic oxide include alumina and tin oxide.

The silica particles and particles composed of an inorganic oxide may be subjected to a surface treatment with a hydrophobizing agent from the viewpoint of improving the stability. As the inorganic oxide, any one type may be used by itself or two or more types may be used in combination.

The content of the external additive is preferably between 2 and 15 parts by mass, more preferably between 4 and 10 parts by mass, furthermore preferably between 4 and 8 parts by mass with respect to 100 parts by mass of the toner base particles. When the content of the external additive is the above lower limit or more, the electric charge amount of the toner is easily ensured. Therefore, the electric charge amount can be more sufficiently maintained even under high temperature and high humidity. When the content of the external additive is the above upper limit or less, the electric charge amount of the toner hardly becomes excessively large. Accordingly, the electric charge amount of the toner is easily moderately maintained.

A method for producing the toner is described herein.

The toner of the embodiment can be produced by mixing the toner base particles and the external additive. By mixing the toner base particles and the external additive, the external additive is adhered to the surfaces of the toner base particles.

The toner base particles of the embodiment can be produced by, for example, a kneading and pulverization method or a chemical method.

The kneading and pulverization method is described herein.

As the kneading and pulverization method, for example, a production method including a mixing step, a kneading step, and a pulverization step described below is exemplified. The kneading and pulverization method may further include a classification step described below as needed.

- a mixing step: a step of mixing at least a crystalline polyester resin and an ester wax, thereby obtaining a mixture
- a kneading step: a step of melt-kneading the mixture, thereby obtaining a kneaded material
- a pulverization step: a step of pulverizing the kneaded material, thereby obtaining a pulverized material
- a classification step: a step of classifying the pulverized material In the mixing step, the raw materials of the toner are mixed, thereby obtaining a mixture. In the mixing step, a mixer may be used. The mixer is not particularly limited. In the mixing step, a colorant, another binder resin, or an additive may be used as needed.

In the kneading step, the mixture obtained in the mixing step is melt-kneaded, thereby obtaining a kneaded material. In the kneading step, a kneader may be used. The kneader is not particularly limited.

In the pulverization step, the kneaded material obtained in the kneading step is pulverized, thereby obtaining a pulverized material. In the pulverization step, a pulverizer may be used. As the pulverizer, various pulverizers such as a hammer mill can be used. In addition, the pulverized material obtained using a pulverizer may be further finely pulverized. As a pulverizer used for further finely pulverizing the pulverized material, various pulverizers can be used. The pulverized material obtained in the pulverization step may be directly used as the toner base particles, or may be used as the toner base particles through the classification step as needed.

In the classification step, the pulverized material obtained in the pulverization step is classified. In the classification step, a classifier may be used. The classifier is not particularly limited.

The chemical method is described herein.

In the chemical method, a crystalline polyester resin, an ester wax, and according to need, another binder resin or an additive are mixed, thereby obtaining a mixture. Subsequently, the mixture is melt-kneaded, thereby obtaining a kneaded material. Subsequently, the kneaded material is pulverized, thereby obtaining coarsely granulated moderately pulverized particles. Subsequently, the moderately pulverized particles are mixed with an aqueous medium, thereby preparing a mixed liquid. Subsequently, the mixed liquid is subjected to mechanical shearing, thereby obtaining a fine particle dispersion liquid. Finally, the fine particles are aggregated in the fine particle dispersion liquid, thereby forming toner base particles.

A method for adding the external additive is described herein.

The external additive is mixed with the toner base particles using, for example, a mixer. The mixer is not particularly limited.

The external additive may be sieved using a sieving device as needed. The sieving device is not particularly limited. Various sieving devices can be used.

A toner cartridge of an embodiment is described herein.

In the toner cartridge of the embodiment, the toner of the embodiment described above is stored. For example, the toner cartridge has a container, and the toner of the embodiment is stored in the container. The container is not particularly limited, and various containers that can be applied to an image forming apparatus can be used.

The toner of the embodiment may be used as a one-component developer or may be combined with a carrier and used as a two-component developer.

Hereinafter, an image forming apparatus of an embodiment is described with reference to the drawing.

FIG. 1 is a diagram showing an example of a schematic structure of the image forming apparatus of the embodiment.

An image forming apparatus 20 of the embodiment has an apparatus body including an intermediate transfer belt 7, and a first image forming unit 17A and a second image forming unit 17B provided in this order on the intermediate transfer belt 7, and a fixing device 21 provided downstream thereof. Along the running direction X of the intermediate transfer belt 7, that is, along the progress direction of the image forming process, the first image forming unit 17A is provided downstream of the second image forming unit 17B. The fixing device 21 is provided downstream of the first image forming unit 17A.

The first image forming unit 17A includes a photoconductive drum 1*a*, a cleaning device 16*a*, a charging device 2*a*, a light exposure device 3*a*, a first developing device 4*a*, and a primary transfer roller 8*a*. The cleaning device 16*a*, the charging device 2*a*, the light exposure device 3*a*, and the first developing device 4*a* are provided in this order along the rotational direction of the photoconductive drum 1*a*. The primary transfer roller 8*a* is provided on the photoconductive drum 1*a* through the intermediate transfer belt 7 so as to face the photoconductive drum 1*a*. To the primary transfer roller 8*a*, a primary transfer power supply 14*a* is connected.

The second image forming unit 17B includes a photoconductive drum 1*b*, a cleaning device 16*b*, a charging device 2*b*, a light exposure device 3*b*, a second developing device 4*b*, and a primary transfer roller 8*b*. The cleaning device 16*b*, the charging device 2*b*, the light exposure device 3*b*, and the second developing device 4*b* are provided in this order along the rotational direction of the photoconductive drum 1*b*. The primary transfer roller 8*b* is provided on the photoconductive drum 1*b* through the intermediate transfer belt 7 so as to face the photoconductive drum 1*b*. To the primary transfer roller 8*b*, a primary transfer power supply 14*b* is connected.

In the first developing device 4*a* and in the second developing device 4*b*, the toner of the embodiment described above is stored. In an image forming apparatus according to another embodiment, the toner may be supplied from a toner cartridge (not shown).

Downstream of the first image forming unit 17A, a secondary transfer roller 9 and a backup roller 10 are disposed so as to face each other through the intermediate transfer belt 7. To the secondary transfer roller 9, a secondary transfer power supply 15 is connected.

The fixing device 21 is provided downstream of the first image forming unit 17A. The fixing device 21 includes a heat roller 11 and a press roller 12 disposed so as to face each other. The fixing device 21 is a device for fixing the toner to a recording medium. A toner image is fixed to paper by heating and pressing using the heat roller 11 and the press roller 12.

By the image forming apparatus 20, image formation is performed, for example, as follows.

First, by the charging device 2*b*, the photoconductive drum 1*b* is uniformly charged. Subsequently, by the light exposure device 3*b*, light exposure is performed, whereby an electrostatic latent image is formed. Subsequently, the electrostatic latent image is developed using the toner of the embodiment supplied from the developing device 4*b*, whereby a second toner image is obtained.

Subsequently, by the charging device 2*a*, the photoconductive drum 1*a* is uniformly charged. Subsequently, by the light exposure device 3*a*, light exposure is performed based on the first image information (second toner image), whereby an electrostatic latent image is formed. Subsequently, the electrostatic latent image is developed using the toner of the embodiment supplied from the developing device 4*a*, whereby a first toner image is obtained.

The second toner image and the first toner image are transferred in this order onto the intermediate transfer belt 7 using the primary transfer rollers 8*a* and 8*b*.

An image in which the second toner image and the first toner image are stacked in this order on the intermediate transfer belt 7 is secondarily transferred onto a recording medium (not shown) through the secondary transfer roller 9 and the backup roller 10. By doing this, an image in which the first toner image and the second toner image are stacked in this order is formed on the recording medium.

The image forming apparatus shown in FIG. 1 is configured to fix a toner image. However, the image forming apparatus of the embodiment is not limited to this configuration. An image forming apparatus according to another embodiment may be, for example, configured to use an inkjet system.

The toner of at least one embodiment described above has excellent low-temperature fixability, storage stability, and heat resistance, and can sufficiently maintain the electric charge amount even under high temperature and high humidity.

Examples

Hereinafter, the embodiments are more specifically described by showing Examples.

Preparation of ester waxes A to O in Examples are described.

Into a four-neck flask equipped with a stirrer, a thermocouple, and a nitrogen introduction tube, 80 parts by mass of at least three or more types of long-chain alkyl carboxylic acids and 20 parts by mass of at least two or more types of long-chain alkyl alcohols were added. An esterification reaction was performed at 220° C. under a nitrogen gas stream, whereby a reaction product was obtained. To the obtained reaction product, a mixed solvent of toluene and ethanol was added, thereby dissolving the reaction product. Further, a sodium hydroxide aqueous solution was added to the flask, and the resultant was stirred at 70° C. for 30 minutes. Further, the flask was left to stand for 30 minutes to separate the contents of the flask into an organic layer and an aqueous layer, and then, the aqueous layer was removed from the contents. Thereafter, ion exchanged water was added to the flask, and the resultant was stirred at 70° C. for 30 minutes. The flask was left to stand for 30 minutes to separate the contents of the flask into an aqueous layer and an organic layer, and then, the aqueous layer was removed from the contents. Such an operation was repeated five times. The solvent was distilled off from the organic layer in the contents of the flask under a reduced pressure condition, whereby an ester wax A was obtained.

Ester waxes B to O were obtained in the same manner as the ester wax A except that the types of the long-chain alkyl carboxylic acids and the long-chain alkyl alcohols used, and the used amounts thereof were changed.

The long-chain alkyl carboxylic acids used are as follows.

Palmitic acid ($C_{16}H_{32}O_2$)
Stearic acid ($C_{18}H_{36}O_2$)
Arachidonic acid ($C_{20}H_{40}O_2$)
Behenic acid ($C_{22}H_{44}O_2$)
Lignoceric acid ($C_{24}H_{48}O_2$)
Cerotic acid ($C_{26}H_{52}O_2$)
Montanic acid ($C_{28}H_{56}O_2$)

The long-chain alkyl alcohols used are as follows.

Palmityl alcohol ($C_{16}H_{34}O$)
Stearyl alcohol ($C_{18}H_{38}O$)
Arachidyl alcohol ($C_{20}H_{42}O$)
Behenyl alcohol ($C_{22}H_{46}O$)
Lignoceryl alcohol ($C_{24}H_{50}O$)
Ceryl alcohol ($C_{26}H_{54}O$)
Montanyl alcohol ($C_{28}H_{58}O$)

Crystalline polyester resins A to G used in the respective Examples are described.

The mass average molecular weight Mw and the melting point of each of the crystalline polyester resins A to G were as follows, respectively.

Crystalline polyester resin A (Mw: 8000, melting point: 65° C.)
Crystalline polyester resin B (Mw: 8300, melting point: 70° C.)
Crystalline polyester resin C (Mw: 8500, melting point: 80° C.)
Crystalline polyester resin D (Mw: 9000, melting point: 85° C.)
Crystalline polyester resin E (Mw: 9300, melting point: 90° C.)
Crystalline polyester resin F (Mw: 9500, melting point: 100° C.)
Crystalline polyester resin G (Mw: 13000, melting point: 110° C.)

The mass average molecular weight of an amorphous polyester resin used in the respective Examples was 20000, and the melting point thereof was 110° C.

Hydrophobic strontium titanate and hydrophobic titanium oxide used in the respective Examples have a volume average primary particle diameter ($D_{50}$) of 20 nm.

Hydrophobic silica β1 used in the respective Examples has a volume average primary particle diameter ($D_{50}$) of 30 nm.

A toner of Example 1 was produced as follows.

First, the raw materials of toner base particles were placed in a Henschel mixer (manufactured by Mitsui Mining Co., Ltd.) and mixed. Further, the mixture of the raw materials of the toner base particles was melt-kneaded using a twin-screw extruder. The resulting melt-kneaded material was cooled, and then, coarsely pulverized using a hammer mill. The coarsely pulverized material was finely pulverized using a jet pulverizer. The finely pulverized material was classified, whereby toner base particles were obtained. The volume average particle diameter of the toner base particles was 6 μm.

The composition of the raw materials of the toner base particles is shown below.

| | |
|---|---|
| Crystalline polyester resin D | 10 parts by mass |
| Ester wax A | 3 parts by mass |
| Amorphous polyester resin | 80 parts by mass |
| Carbon black | 6 parts by mass |
| Charge control agent (polysaccharide inclusion compound containing Al and Mg) | 1 part by mass |

Subsequently, with respect to 100 parts by mass of the toner base particles of Example 1, an external additive having the following composition was mixed using a Henschel mixer, whereby a toner of Example 1 was produced.

| | |
|---|---|
| Silica particles A | 1 part by mass |
| Hydrophobic silica β1 | 2 parts by mass |
| Hydrophobic strontium titanate | 1 part by mass |

A toner of Example 2 was produced as follows.

First, toner base particles of Example 2 were produced in the same manner as in Example 1 except that the composition of the raw materials of the toner base particles was changed as follows. The volume average particle diameter of the toner base particles of Example 2 was 6 μm.

| | |
|---|---|
| Crystalline polyester resin G | 10 parts by mass |
| Ester wax B | 3 parts by mass |
| Amorphous polyester resin | 80 parts by mass |
| Carbon black | 6 parts by mass |
| Charge control agent (polysaccharide inclusion compound containing Al and Mg) | 1 part by mass |

Subsequently, a toner of Example 2 was produced by mixing an external additive in the same manner as in Example 1 except that the composition of the external additive was changed as follows.

| | |
|---|---|
| Silica particles B | 1 part by mass |
| Hydrophobic silica β1 | 2 parts by mass |
| Hydrophobic strontium titanate | 1 part by mass |

A toner of Example 3 was produced as follows.

First, toner base particles of Example 3 were produced in the same manner as in Example 1 except that the composition of the raw materials of the toner base particles was changed as follows. The volume average particle diameter of the toner base particles of Example 3 was 6 μm.

| | |
|---|---|
| Crystalline polyester resin B | 10 parts by mass |
| Ester wax C | 3 parts by mass |
| Amorphous polyester resin | 80 parts by mass |
| Carbon black | 6 parts by mass |
| Charge control agent (polysaccharide inclusion compound containing Al and Mg) | 1 part by mass |

Subsequently, a toner of Example 3 was produced by mixing an external additive in the same manner as in Example 1 except that the composition of the external additive was changed as follows.

| | |
|---|---|
| Silica particles C | 1 part by mass |
| Hydrophobic silica β1 | 2 parts by mass |
| Hydrophobic strontium titanate | 1 part by mass |

A toner of Example 4 was produced as follows.

First, toner base particles of Example 4 were produced in the same manner as in Example 1 except that the composition of the raw materials of the toner base particles was changed as follows. The volume average particle diameter of the toner base particles of Example 4 was 6 μm.

| | |
|---|---|
| Crystalline polyester resin G | 10 parts by mass |
| Ester wax D | 3 parts by mass |
| Amorphous polyester resin | 80 parts by mass |
| Carbon black | 6 parts by mass |
| Charge control agent (polysaccharide inclusion compound containing Al and Mg) | 1 part by mass |

Subsequently, a toner of Example 4 was produced by mixing an external additive in the same manner as in Example 1 except that the composition of the external additive was changed as follows.

| | |
|---|---|
| Silica particles D | 1 part by mass |
| Hydrophobic silica β1 | 2 parts by mass |
| Hydrophobic strontium titanate | 1 part by mass |

A toner of Example 5 was produced as follows.

First, toner base particles of Example 5 were produced in the same manner as in Example 1 except that the composition of the raw materials of the toner base particles was changed as follows. The volume average particle diameter of the toner base particles of Example 5 was 6 μm.

| | |
|---|---|
| Crystalline polyester resin C | 10 parts by mass |
| Ester wax E | 3 parts by mass |
| Amorphous polyester resin | 80 parts by mass |
| Carbon black | 6 parts by mass |
| Charge control agent (polysaccharide inclusion compound containing Al and Mg) | 1 part by mass |

Subsequently, a toner of Example 5 was produced by mixing an external additive in the same manner as in Example 1 except that the composition of the external additive was changed as follows.

| | |
|---|---|
| Silica particles A | 1 part by mass |
| Hydrophobic silica β1 | 2 parts by mass |
| Hydrophobic strontium titanate | 1 part by mass |

A toner of Example 6 was produced as follows.

First, toner base particles of Example 6 were produced in the same manner as in Example 1 except that the composition of the raw materials of the toner base particles was changed as follows. The volume average particle diameter of the toner base particles of Example 6 was 6 μm.

| | |
|---|---|
| Crystalline polyester resin F | 10 parts by mass |
| Ester wax F | 3 parts by mass |
| Amorphous polyester resin | 80 parts by mass |
| Carbon black | 6 parts by mass |

-continued

| | |
|---|---|
| Charge control agent (polysaccharide inclusion compound containing Al and Mg) | 1 part by mass |

Subsequently, a toner of Example 6 was produced by mixing an external additive in the same manner as in Example 1 except that the composition of the external additive was changed as follows.

| | |
|---|---|
| Silica particles D | 1 part by mass |
| Hydrophobic silica β1 | 2 parts by mass |
| Hydrophobic strontium titanate | 1 part by mass |

A toner of Comparative Example 1 was produced as follows.

First, toner base particles of Comparative Example 1 were produced in the same manner as in Example 1 except that the composition of the raw materials of the toner base particles was changed as follows. The volume average particle diameter of the toner base particles of Comparative Example 1 was 6 μm.

| | |
|---|---|
| Crystalline polyester resin E | 10 parts by mass |
| Ester wax G | 3 parts by mass |
| Amorphous polyester resin | 80 parts by mass |
| Carbon black | 6 parts by mass |
| Charge control agent (polysaccharide inclusion compound containing Al and Mg) | 1 part by mass |

Subsequently, a toner of Comparative Example 1 was produced by mixing an external additive in the same manner as in Example 1 except that the composition of the external additive was changed as follows.

| | |
|---|---|
| Silica particles E | 1 part by mass |
| Hydrophobic silica β1 | 2 parts by mass |
| Hydrophobic titanium oxide | 1 part by mass |

A toner of Comparative Example 2 was produced as follows.

First, toner base particles of Comparative Example 2 were produced in the same manner as in Example 1 except that the composition of the raw materials of the toner base particles was changed as follows. The volume average particle diameter of the toner base particles of Comparative Example 2 was 6 μm.

| | |
|---|---|
| Crystalline polyester resin F | 10 parts by mass |
| Ester wax H | 3 parts by mass |
| Amorphous polyester resin | 80 parts by mass |
| Carbon black | 6 parts by mass |
| Charge control agent (polysaccharide inclusion compound containing Al and Mg) | 1 part by mass |

Subsequently, a toner of Comparative Example 2 was produced by mixing an external additive in the same manner as in Example 1 except that the composition of the external additive was changed as follows.

| | |
|---|---|
| Silica particles F | 1 part by mass |
| Hydrophobic silica β1 | 2 parts by mass |
| Hydrophobic strontium titanate | 1 part by mass |

A toner of Comparative Example 3 was produced as follows.

First, toner base particles of Comparative Example 3 were produced in the same manner as in Example 1 except that the composition of the raw materials of the toner base particles was changed as follows. The volume average particle diameter of the toner base particles of Comparative Example 3 was 6 μm.

| | |
|---|---|
| Crystalline polyester resin G | 10 parts by mass |
| Ester wax I | 3 parts by mass |
| Amorphous polyester resin | 80 parts by mass |
| Carbon black | 6 parts by mass |
| Charge control agent (polysaccharide inclusion compound containing Al and Mg) | 1 part by mass |

Subsequently, a toner of Comparative Example 3 was produced by mixing an external additive in the same manner as in Example 1 except that the composition of the external additive was changed as follows.

| | |
|---|---|
| Silica particles G | 1 part by mass |
| Hydrophobic silica β1 | 2 parts by mass |
| Hydrophobic titanium oxide | 1 part by mass |

A toner of Comparative Example 4 was produced as follows.

First, toner base particles of Comparative Example 4 were produced in the same manner as in Example 1 except that the composition of the raw materials of the toner base particles was changed as follows. The volume average particle diameter of the toner base particles of Comparative Example 4 was 6 μm.

| | |
|---|---|
| Ester wax J | 3 parts by mass |
| Amorphous polyester resin | 90 parts by mass |
| Carbon black | 6 parts by mass |
| Charge control agent (polysaccharide inclusion compound containing Al and Mg) | 1 part by mass |

Subsequently, a toner of Comparative Example 4 was produced by mixing an external additive in the same manner as in Example 1 except that the composition of the external additive was changed as follows.

| | |
|---|---|
| Silica particles C | 1 part by mass |
| Hydrophobic silica β1 | 2 parts by mass |
| Hydrophobic titanium oxide | 1 part by mass |

A toner of Comparative Example 5 was produced as follows.

First, toner base particles of Comparative Example 5 were produced in the same manner as in Example 1 except that the composition of the raw materials of the toner base particles was changed as follows. The volume average particle diameter of the toner base particles of Comparative Example 5 was 6 μm.

| | |
|---|---|
| Crystalline polyester resin A | 10 parts by mass |
| Ester wax K | 3 parts by mass |
| Amorphous polyester resin | 80 parts by mass |
| Carbon black | 6 parts by mass |
| Charge control agent (polysaccharide inclusion compound containing Al and Mg) | 1 part by mass |

Subsequently, a toner of Comparative Example 5 was produced by mixing an external additive in the same manner as in Example 1 except that the composition of the external additive was changed as follows.

| | |
|---|---|
| Silica particles H | 1 part by mass |
| Hydrophobic silica β1 | 2 parts by mass |
| Hydrophobic strontium titanate | 1 part by mass |

A toner of Comparative Example 6 was produced as follows.

First, toner base particles of Comparative Example 6 were produced in the same manner as in Example 1 except that the composition of the raw materials of the toner base particles was changed as follows. The volume average particle diameter of the toner base particles of Comparative Example 6 was 6 μm.

| | |
|---|---|
| Crystalline polyester resin C | 10 parts by mass |
| Ester wax L | 3 parts by mass |
| Amorphous polyester resin | 80 parts by mass |
| Carbon black | 6 parts by mass |
| Charge control agent (polysaccharide inclusion compound containing Al and Mg) | 1 part by mass |

Subsequently, a toner of Comparative Example 6 was produced by mixing an external additive in the same manner as in Example 1 except that the composition of the external additive was changed as follows.

| | |
|---|---|
| Silica particles D | 1 part by mass |
| Hydrophobic silica β1 | 2 parts by mass |
| Hydrophobic titanium oxide | 1 part by mass |

A toner of Comparative Example 7 was produced as follows.

First, toner base particles of Comparative Example 7 were produced in the same manner as in Example 1 except that the composition of the raw materials of the toner base particles was changed as follows. The volume average particle diameter of the toner base particles of Comparative Example 7 was 6 μm.

| | |
|---|---|
| Crystalline polyester resin E | 10 parts by mass |
| Ester wax M | 3 parts by mass |
| Amorphous polyester resin | 80 parts by mass |
| Carbon black | 6 parts by mass |
| Charge control agent (polysaccharide inclusion compound containing Al and Mg) | 1 part by mass |

Subsequently, a toner of Comparative Example 7 was produced by mixing an external additive in the same manner as in Example 1 except that the composition of the external additive was changed as follows.

| | |
|---|---|
| Silica particles I | 1 part by mass |
| Hydrophobic silica β1 | 2 parts by mass |
| Hydrophobic strontium titanate | 1 part by mass |

A toner of Comparative Example 8 was produced as follows.

First, toner base particles of Comparative Example 8 were produced in the same manner as in Example 1 except that the composition of the raw materials of the toner base particles was changed as follows. The volume average particle diameter of the toner base particles of Comparative Example 8 was 6 μm.

| | |
|---|---|
| Crystalline polyester resin A | 10 parts by mass |
| Ester wax N | 3 parts by mass |
| Amorphous polyester resin | 80 parts by mass |
| Carbon black | 6 parts by mass |
| Charge control agent (polysaccharide inclusion compound containing Al and Mg) | 1 part by mass |

Subsequently, a toner of Comparative Example 8 was produced by mixing an external additive in the same manner as in Example 1 except that the composition of the external additive was changed as follows.

| | |
|---|---|
| Silica particles J | 1 part by mass |
| Hydrophobic silica β1 | 2 parts by mass |
| Hydrophobic titanium oxide | 1 part by mass |

A toner of Comparative Example 9 was produced as follows.

First, toner base particles of Comparative Example 9 were produced in the same manner as in Example 1 except that the composition of the raw materials of the toner base particles was changed as follows. The volume average particle diameter of the toner base particles of Comparative Example 9 was 6 μm.

| | |
|---|---|
| Crystalline polyester resin C | 10 parts by mass |
| Ester wax O | 3 parts by mass |
| Amorphous polyester resin | 80 parts by mass |
| Carbon black | 6 parts by mass |
| Charge control agent (polysaccharide inclusion compound containing Al and Mg) | 1 part by mass |

Subsequently, a toner of Comparative Example 9 was produced by mixing an external additive in the same manner as in Example 1 except that the composition of the external additive was changed as follows.

| | |
|---|---|
| Silica particles K | 1 part by mass |
| Hydrophobic silica β1 | 2 parts by mass |
| Hydrophobic titanium oxide | 1 part by mass |

A method for measuring the carbon number distribution of the ester compounds (the proportion of each of the ester compounds with the corresponding carbon number) constituting the ester wax will be described.

0.5 g of each of the toners of the respective Examples was weighed and added into an Erlenmeyer flask. Subsequently, 2 mL of methylene chloride was added to the Erlenmeyer flask to dissolve the toner. Further, 4 mL of hexane was added to the Erlenmeyer flask to form a mixed liquid. The mixed liquid was filtered and separated into a filtrate and an insoluble material. The solvent was distilled off from the filtrate under a nitrogen gas stream, whereby a deposited material was obtained. With respect to the deposited material, the carbon number distribution of the ester compounds in the ester wax extracted from the toner was measured.

The proportion of each of the ester compounds with the corresponding carbon number was measured using FD-MS "JMS-T100GC (manufactured by JEOL Ltd.)". The measurement conditions are as follows.

Sample concentration: 1 mg/mL (solvent: chloroform)

Cathode voltage: −10 kv

Spectral recording interval: 0.4 s

Measurement mass range (m/z): between 10 and 2000

The total ionic strength of the ester compounds with the corresponding carbon number obtained by the measurement was assumed to be 100. The relative value of the ionic strength of each of the ester compounds with the corresponding carbon number with respect to the total ionic strength was determined. The relative value was defined as the proportion of each of the ester compounds with the corresponding carbon number in the ester wax. Further, the carbon number of the ester compound with a carbon number, the relative value of which is highest, is denoted by $C_l$.

The method used for analyzing the first monomer group and the second monomer group is described.

1 g of each ester wax was subjected to a methanolysis reaction under the conditions of a temperature of 70° C. for 3 hours. The product after the methanolysis reaction was subjected to mass spectrometry using FD-MS, and the content of each of the long-chain alkyl carboxylic acids with the corresponding carbon number and the content of each of the long-chain alkyl alcohols with the corresponding carbon number were determined.

The method used for measuring the carbon number distribution of the carboxylic acids (the proportion of each of the carboxylic acids with the corresponding carbon number) constituting the first monomer group is described.

The proportion of each of the carboxylic acids with the corresponding carbon number was measured using FD-MS "JMS-T100GC (manufactured by JEOL Ltd.)". The measurement conditions are as follows.

Sample concentration: 1 mg/mL (solvent: chloroform)

Cathode voltage: −10 kv

Spectral recording interval: 0.4 s

Measurement mass range (m/z): between 10 and 2000

The total ionic strength of the carboxylic acids with the corresponding carbon number obtained by the measurement was assumed to be 100. The relative value of the ionic strength of each of the carboxylic acids with the corresponding carbon number with respect to the total ionic strength was determined. The relative value was defined as the proportion of each of the carboxylic acids with the corresponding carbon number in the ester wax. Further, the carbon number of the carboxylic acid with a carbon number, the relative value of which is highest, is denoted by $C_n$.

The method used for measuring the carbon number distribution of the alcohols (the proportion of each of the alcohols with the corresponding carbon number) constituting the second monomer group is described.

The proportion of each of the alcohols with the corresponding carbon number was measured using FD-MS "JMS-T100GC (manufactured by JEOL Ltd.)". The measurement conditions are as follows.

Sample concentration: 1 mg/mL (solvent: chloroform)

Cathode voltage: −10 kv

Spectral recording interval: 0.4 s

Measurement mass range (m/z): between 10 and 2000

The total ionic strength of the alcohols with the corresponding carbon number obtained by the measurement was assumed to be 100. The relative value of the ionic strength of each of the alcohols with the corresponding carbon number with respect to the total ionic strength was determined. The relative value was defined as the proportion of each of the alcohols with the corresponding carbon number in the ester wax. Further, the carbon number of the alcohol with a carbon number, the relative value of which is highest, is denoted by $C_m$.

The ester waxes A to O used in the respective Examples is described.

With respect to the ester waxes A to O, the carbon number $C_l$ of the ester compound, the content of which is highest, the carbon number $C_n$ of the carboxylic acid, the content of which is highest in the first monomer group, and the carbon number $C_m$ of the alcohol, the content of which is highest in the second monomer group were as follows, respectively.

Ester wax A ($C_l$: 44, $C_n$: 22, $C_m$: 22)
Ester wax B ($C_l$: 44, $C_n$: 20, $C_m$: 24)
Ester wax C ($C_l$: 44, $C_n$: 24, $C_m$: 20)
Ester wax D ($C_l$: 44, $C_n$: 22, $C_m$: 22)
Ester wax E ($C_l$: 44, $C_n$: 20, $C_m$: 24)
Ester wax F ($C_l$: 44, $C_n$: 22, $C_m$: 22)
Ester wax G ($C_l$: 42, $C_n$: 18, $C_m$: 24)
Ester wax H ($C_l$: 44, $C_n$: 18, $C_m$: 26)
Ester wax I ($C_l$: 44, $C_n$: 26, $C_m$: 18)
Ester wax J ($C_l$: 44, $C_n$: 22, $C_m$: 22)
Ester wax K ($C_l$: 44, $C_n$: 20, $C_m$: 24)
Ester wax L ($C_l$: 44, $C_n$: 22, $C_m$: 22)
Ester wax M ($C_l$: 46, $C_n$: 24, $C_m$: 22)
Ester wax N ($C_l$: 46, $C_n$: 22, $C_m$: 22)
Ester wax O ($C_l$: 36, $C_n$: 18, $C_m$: 18)

With respect to the ester waxes A to F and H to N, the carbon number distribution of the ester wax had only one maximum peak in a region where the carbon number is 43 or more. The ester waxes G and O did not meet the condition that the carbon number distribution of the ester wax has only one maximum peak in a region where the carbon number is 43 or more. The properties of the ester waxes A to O obtained from the measurement results of the carbon number distribution are shown in Table 1.

TABLE 1

| | $C_l$ | a | $b_1$ | $b_2$ | $c_1$ | $c_2$ | $d_1$ | $d_2$ |
|---|---|---|---|---|---|---|---|---|
| Ester wax A | 44 | 70 | 4 | 3 | 3 | 15 | 70 | 70 |
| Ester wax B | 44 | 75 | 3 | 3 | 2 | 15 | 95 | 70 |
| Ester wax C | 44 | 75 | 3 | 2 | 0 | 5 | 90 | 90 |
| Ester wax D | 44 | 80 | 3 | 4 | 0 | 5 | 90 | 90 |
| Ester wax E | 44 | 65 | 3 | 3 | 5 | 18 | 85 | 82 |
| Ester wax F | 44 | 80 | 3 | 4 | 5 | 18 | 90 | 75 |
| Ester wax G | 42 | 70 | 5 | 3 | 1 | 15 | 65 | 55 |
| Ester wax H | 44 | 60 | 3 | 4 | 5 | 38 | 70 | 70 |
| Ester wax I | 44 | 65 | 3 | 3 | 10 | 15 | 60 | 60 |
| Ester wax J | 44 | 80 | 3 | 3 | 10 | 40 | 85 | 50 |
| Ester wax K | 44 | 70 | 4 | 5 | 10 | 40 | 80 | 50 |
| Ester wax L | 44 | 60 | 2 | 3 | 5 | 15 | 95 | 85 |
| Ester wax M | 46 | 70 | 3 | 2 | 3 | 5 | 90 | 95 |
| Ester wax N | 46 | 70 | 3 | 2 | 3 | 5 | 90 | 95 |
| Ester wax O | 44 | 75 | 1 | 1 | 100 | 100 | 100 | 100 |

In Table 1, $C_l$ is the carbon number of the ester compound, the content of which is highest among the ester compounds constituting the corresponding ester wax. a is the proportion [mass %] of the ester compound with a carbon number of $C_l$ with respect to 100 mass % of the ester wax. $b_1$ is the number of types [types] of carboxylic acids in the first monomer group. $b_2$ is the number of types [types] of alcohols in the second monomer group. $c_1$ is the total proportion [mass %] of the carboxylic acids with a carbon number of 18 or less with respect to 100 mass % of the first monomer group. $c_2$ is the total proportion [mass %] of the alcohols with a carbon number of 18 or less with respect to 100 mass % of the second monomer group. $d_1$ is the proportion [mass %] of the carboxylic acid with a carbon number of $C_n$ with respect to 100 mass % of the first monomer group. $d_2$ is the proportion [mass %] of the alcohol with a carbon number of $C_m$ with respect to 100 mass % of the second monomer group.

The method used for measuring the volume average primary particle diameter ($D_{50}$) is described.

A laser diffraction particle size distribution analyzer (manufactured by Shimadzu Corporation (SALD-7000)) was used.

With respect to the silica particles A to K used in the respective Examples, the $D_{50}$ and the joining degree were as follows, respectively.

Silica particles A ($D_{50}$: 80 nm, joining degree: 90%)
Silica particles B ($D_{50}$: 110 nm, joining degree: 84%)
Silica particles C ($D_{50}$: 95 nm, joining degree: 89%)
Silica particles D ($D_{50}$: 100 nm, joining degree: 82%)
Silica particles E ($D_{50}$: 58 nm, joining degree: 80%)
Silica particles F ($D_{50}$: 48 nm, joining degree: 88%)
Silica particles G ($D_{50}$: 172 nm, joining degree: 40%)
Silica particles H ($D_{50}$: 110 nm, joining degree: 25%)
Silica particles I ($D_{50}$: 80 nm, joining degree: 60%)
Silica particles J ($D_{50}$: 50 nm, joining degree: 77%)
Silica particles K ($D_{50}$: 98 nm, joining degree: 50%)

The method used for measuring the joining degree of the silica particles is described.

With respect to the toners of the respective Examples, an electron micrograph was captured using a scanning electron microscope (manufactured by Zeiss Co., Ltd.). An analysis was performed using an image analysis software, and with respect to the silica particles α adhered to the surface of the toner base particle, the number of primary particles ($n_1$) and the number of secondary particles ($n_2$) were counted. By using an image analysis software, a silica particle in which the ratio of the minor axis to the major axis of a particle, that is, the aspect ratio is less than 0.92 was distinguished to be a secondary particle. A particle for which the determination is hardly made using the image analysis software due to overlapping with silica or the like, the determination was visually performed. Here, in the scanning electron microscope, the silica particle α and the silica particle β can be discriminated from each other, and therefore, the joining degree can be calculated for the silica particle α adhered to the surface of the toner base particle.

Subsequently, the joining degree was calculated based on the following formula, and an average for 20 toner particles was determined to be the joining degree. The measurement results of the joining degree of the silica particles α (that is, the silica particles A to D) adhered to the toner base particle are shown in Table 2.

$$\text{joining degree } (\%)=(n_2/(n_1+n_2))\times 100$$

The developers of the Examples are described.

With respect to 100 parts by mass of ferrite carrier, 8.5 parts by mass of each of the toners of the respective Examples was stirred using a Turbula mixer, whereby developers of the respective Examples were obtained. The surface of the ferrite carrier is coated with a silicone resin having an average particle diameter of 40 μm.

The method used for evaluating the storage stability is described.

Each of the toners of the respective Examples was left at 55° C. for 10 hours. 15 g of each of the toners of the respective Examples after being left at 55° C. for 10 hours was sieved through a mesh, and the toner remaining on the mesh was weighed. The amount of the toner remaining on the mesh is preferably as small as possible. When the amount of the toner remaining on the mesh was 3 g or less, the storage stability of the toner was evaluated as pass (good). When the amount of the toner remaining on the mesh was more than 3 g, the storage stability of the toner was evaluated as fail (bad).

The method used for evaluating the heat resistance is described.

Each of the developers of the respective Examples was stored in a toner cartridge. The toner cartridge was placed in an image forming apparatus for evaluating the heat resistance. The image forming apparatus for evaluating the heat resistance is an apparatus obtained by attaching a thermocouple to a developing device of commercially available e-studio 6530c (manufactured by Toshiba Tec Corporation). By using the image forming apparatus for evaluating the heat resistance, an original document with a printing ratio of 4.0% was continuously copied on A4 size paper. Whether or not conveyance failure or a defective image occurred was confirmed every time the temperature in the developing device was raised by 2° C. while copying, and the temperature at which conveyance failure or a defective image started to occur was recorded. When the temperature at which conveyance failure or a defective image started to occur was 47° C. or higher, the heat resistance of the toner was evaluated as pass (good). When the temperature at which conveyance failure or a defective image started to occur was lower than 45° C., the heat resistance of the toner was evaluated as fail (bad).

The method used for evaluating the low-temperature fixability is described.

Each of the developers of the respective Examples was stored in a toner cartridge. The toner cartridge was placed in an image forming apparatus for evaluating the low-temperature fixability. The image forming apparatus for evaluating the low-temperature fixability is an apparatus obtained by modifying commercially available e-studio 6530c (manufactured by Toshiba Tec Corporation) so that the fixing temperature can be set by changing the temperature by 0.1° C. at a time between 100° C. and 200° C. By using the image forming apparatus for evaluating the low-temperature fixability and setting the fixing temperature to 150° C., 10 sheets of a solid image at a toner adhesion amount of 1.5 mg/cm$^2$ were obtained. When image peeling due to offset or unfixing did not occur on all the 10 sheets of the solid image, the set temperature was decreased by 1° C., and a solid image was obtained in the same manner as described above. This operation was repeated, and the lower limit temperature of the fixing temperature at which image peeling did not occur on the solid image was determined, and the lower limit temperature was defined as the lowest fixing temperature of the toner. When the lowest fixing temperature was 120° C. or lower, the low-temperature fixability of the toner was evaluated as pass (good). When the lowest fixing temperature was higher than 120° C., the low-temperature fixability of the toner was evaluated as fail (bad).

The method used for evaluating the electric charge amount is described.

By using commercially available e-studio 5005AC (manufactured by Toshiba Tec Corporation), an original document with a printing ratio of 8.0% was continuously copied on 200,000 sheets of A4 size paper. Thereafter, the toner deposited below a magnet roller of a developing device was sucked with a vacuum cleaner, and the amount of the deposited toner was measured as the amount of the contaminant toner. When the amount of the contaminant toner was 170 mg or less, the electric charge amount of the toner was evaluated as pass (good). When the amount of the contaminant toner was more than 170 mg, the electric charge amount of the toner was evaluated as fail (bad).

TABLE 2

| | Ester wax | $D_{50}$ | Joining degree | Low-temperature fixability | Storage stability | Heat resistance | Electric charge amount |
|---|---|---|---|---|---|---|---|
| Example 1 | A | 80 | 90 | good | good | good | good |
| Example 2 | B | 110 | 84 | good | good | good | good |
| Example 3 | C | 95 | 89 | good | good | good | good |
| Example 4 | D | 100 | 82 | good | good | good | good |
| Example 5 | E | 80 | 90 | good | good | good | good |
| Example 6 | F | 100 | 82 | good | good | good | good |
| Comparative Example 1 | G | 58 | 80 | good | good | bad | bad |
| Comparative Example 2 | H | 48 | 88 | good | good | bad | bad |
| Comparative Example 3 | I | 172 | 40 | good | good | bad | bad |
| Comparative Example 4 | J | 95 | 89 | bad | good | good | good |
| Comparative Example 5 | K | 110 | 25 | good | bad | bad | bad |

TABLE 2-continued

| | Ester wax | $D_{50}$ | Joining degree | Low-temperature fixability | Storage stability | Heat resistance | Electric charge amount |
|---|---|---|---|---|---|---|---|
| Comparative Example 6 | L | 100 | 82 | good | bad | good | good |
| Comparative Example 7 | M | 80 | 60 | good | bad | bad | bad |
| Comparative Example 8 | N | 50 | 77 | good | bad | bad | bad |
| Comparative Example 9 | O | 98 | 50 | good | bad | bad | bad |

The evaluation results of the low-temperature fixability, storage stability, heat resistance, and electric charge amount of each of the toners of the respective Examples are shown in Table 2.

The toners of Examples 1 to 6 had excellent low-temperature fixability, storage stability, and heat resistance. Further, the amount of the contaminant toner was small, and the electric charge amount could be sufficiently maintained even under high temperature and high humidity in the image forming apparatus.

On the other hand, the toners of Comparative Examples 1 to 9 did not simultaneously meet the pass criteria for all the low-temperature fixability, storage stability, heat resistance, and electric charge amount.

Subsequently, the relationship between the joining degree of the silica particles and the adhesion strength was measured.

Specifically, with respect to the toners in which the joining degree of the silica particles was changed, the adhesion strength of the external additive was measured. First, the external additive was detached by applying a high air pressure to the toners using a cyclone collector. The toners before and after detaching the external additive were subjected to an X-ray fluorescence (XRF) analysis, and a peak intensity of an Si element on the surface of the toner base particle was measured.

adhesion strength (%)=((peak intensity of Si element after detaching external additive)/(peak intensity of Si element before detaching external additive))×100

As the ratio of the peak intensity of the Si element between before and after detaching the external additive is closer to 1, the adhesion strength is higher.

Figure 2:
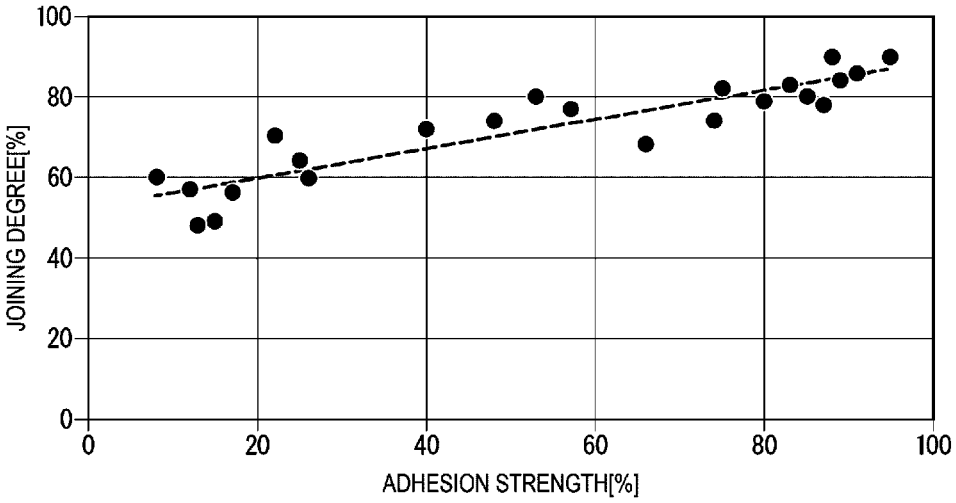
FIG. 2 is a graph showing measurement results for a relationship between the joining degree of silica particles and the adhesion strength of an external additive in Examples.

FIG. 2 shows the measurement results for the relationship between the joining degree of the silica particles and the adhesion strength of the external additive. As shown in FIG. 2, a correlation was confirmed between the joining degree of the silica particles and the adhesion strength.

It is found that when the joining degree of the silica particles is 80% or more, the adhesion strength of the external additive becomes high. Therefore, it is considered that when the joining degree of the silica particles is 80% or more, the electric charge amount of the toner is easily maintained.

While certain embodiments of the invention have been described, these embodiments have been presented by way of example only, and are not intended to limit the scope of the invention. The embodiments described herein may be embodied in various other forms, and various omissions, substitutions, and changes may be made without departing from the gist of the invention. The embodiments and modifications thereof are included in the scope and gist of the invention and also included in the invention described in the claims and in the scope of their equivalents.

What is claimed is:

1. A toner comprising:

toner base particles; and an external additive attached to surfaces of the toner base particles, wherein the toner base particles comprise a crystalline polyester resin and an ester wax, the ester wax is a condensation polymer of a first monomer group comprising at least three or more types of carboxylic acids and a second monomer group comprising at least two or more types of alcohols, the proportion of a carboxylic acid with a carbon number of $C_n$, the content of which is highest in the first monomer group, is between 70 and 95 mass % with respect to 100 mass % of the first monomer group, the proportion of a carboxylic acid with a carbon number of 18 or less in the first monomer group is 5 mass % or less with respect to 100 mass % of the first monomer group, the proportion of an alcohol with a carbon number of $C_m$, the content of which is highest in the second monomer group, is between 70 and 90 mass % with respect to 100 mass % of the second monomer group, the proportion of an alcohol with a carbon number of 18 or less in the second monomer group is 20 mass % or less with respect to 100 mass % of the second monomer group, the external additive comprises silica particles having a volume average primary particle diameter ($D_{50}$) of from 70 to 120 nm, the silica particles comprise primary particles of silica and secondary particles in which two or more primary particles of silica are joined together, and a joining degree calculated according to the following formula of the silica particles is 80% or more:

$$\text{joining degree } (\%)=(n_2/(n_1+n_2))\times 100$$

wherein $n_1$ is the number of the primary particles measured for one toner base particle, and $n_2$ is the number of the secondary particles measured for one toner base particle.

2. The toner according to claim 1, wherein the proportion of an ester compound with a carbon number of $C_l$, the content of which is highest among the ester compounds constituting the ester wax, is between 65 and 90 mass % with respect to 100 mass % of the ester wax.

3. The toner according to claim 1, wherein the external additive further comprises either one or both of strontium titanate and titanium oxide.

4. The toner according to claim 1, wherein the content of the external additive is between 2 and 15 parts by mass with respect to 100 parts by mass of the toner base particles.

5. The toner according to claim 1, wherein the crystalline polyester resin has a ratio of softening temperature to melting temperature of from 0.8 to 1.2.

6. The toner according to claim 1, wherein the crystalline polyester resin has a mass average molecular weight of from $6\times10^3$ and $18\times10^3$.

7. The toner according to claim 1, wherein the crystalline polyester resin has a melting point of from 60 to 120° C.

8. The toner according to claim 1, wherein joining degree of the silica particles is from 80 to 95%.

9. The toner according to claim 8, wherein joining degree of the silica particles is from 80 to 90%.

10. The toner according to claim 1, wherein the external additive comprises silica particles having the volume average primary particle diameter ($D_{50}$) of from 75 to 115 nm.

11. The toner according to claim 10, wherein the external additive comprises silica particles having the volume average primary particle diameter ($D_{50}$) of from 80 to 110 nm.

12. The toner according to claim 1, wherein the toner base particles further comprise a colorant, a charge control agent, a surfactant, a basic compound, an aggregating agent, a pH adjusting agent, and/or an antioxidant.

13. A toner cartridge comprising a container comprising a toner according to claim 1.

14. An image forming apparatus comprising a toner cartridge according claim 13.

* * * * *